United States Patent [19]

Sindelar, Sr.

[11] Patent Number: 5,024,442

[45] Date of Patent: Jun. 18, 1991

[54] PUTTING PRACTICE DEVICE

[76] Inventor: Joseph L. Sindelar, Sr., 2121 Hancock Dr., Horseheads, N.Y.

[21] Appl. No.: 540,350

[22] Filed: Jun. 19, 1990

[51] Int. Cl.[5] ..... A63B 69/36

[52] U.S. Cl. ..... 273/186 C; 273/192

[58] Field of Search ..... 273/191 R, 191 A, 191 B, 273/192, 186 R, 186 B, 186 C, 183 E

[56] References Cited

U.S. PATENT DOCUMENTS

| | | | |
|---|---|---|---|
| 1,545,648 | 7/1925 | Fletcher | 273/192 |
| 2,750,195 | 6/1956 | Ching | 273/183 A |
| 2,754,125 | 7/1953 | Engler | 273/192 |
| 2,776,836 | 1/1957 | Zadina | 273/192 |
| 3,125,343 | 3/1964 | Price | 273/186 R |
| 3,332,688 | 7/1967 | Gevertz | 273/192 |
| 3,656,752 | 4/1972 | Moriarty | 273/192 |
| 3,697,080 | 10/1972 | Liotta | 273/186 R |
| 3,753,563 | 8/1973 | Previte | 273/186 C |
| 3,806,133 | 4/1974 | Cork | 273/192 |
| 4,101,130 | 7/1978 | Richards | 2273/187 A |
| 4,398,715 | 8/1983 | Hall | 273/030 |
| 4,453,717 | 6/1984 | Solheim | 273/192 |
| 4,765,624 | 8/1988 | Sprague | 273/192 |
| 4,805,912 | 2/1989 | Hickman | 273/192 |
| 4,927,153 | 5/1990 | Schaeffer | 273/187 R |

*Primary Examiner*—George J. Marlo

*Attorney, Agent, or Firm*—Cushman, Darby & Cushman

[57] ABSTRACT

An elongated putting training aid including lengthwise adjacent and coextensive guide surfaces on its opposite sides defining, respectively, a vertical putter guide surface and an inclined putter guide surface. The vertical putter guide surface enables the golfer to practice straight putting by aligning the vertical surface with a target hole or cup. The inclined surface is utilized for practicing in to in putting wherein the club is drawn in and up on the back swing and in and up on the follow through. The putting aid can be secured to the putting green by inserting tees through suitably disposed apertures in each longitudinal end thereof. In the alternative, the putting aid can be secured to carpeting with a hook-type material provided on the bottom surface thereof.

21 Claims, 3 Drawing Sheets

PUTTING PRACTICE DEVICE

BACKGROUND AND SUMMARY OF THE INVENTION

The present invention relates to a putting trainer for learning and practicing putting strokes. More particularly, by using the putting aid of the invention, the muscles of the user are trained to the particular control and force required for using a particular putting stroke and for putting a particular distance on the green.

By way of background, there are two putting methods in common use by golfers. The first method is the straight back and straight through method of putting wherein the draw back, forward stroke and follow through with the putter are all in a substantially vertical plane. The second putting method is known as the in to in or natural style of putting. With that method the golfer prefers to take the putter head to the inside and slightly up on the back swing, return it to the ball and then bring it in and up on the follow through. That putting stroke is similar to a regular golf swing except it is defined at a steeper angle. The in to in method is also known as the in and up method.

It is an object of the invention to provide a training aid which enables the user to practice both the straight back and straight through method as well as the in to in or in and up putting method so that the user can master both of these putting strokes, train his muscles to consistently employ those strokes on the green and build the confidence required to consistently perform well on the golf course.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
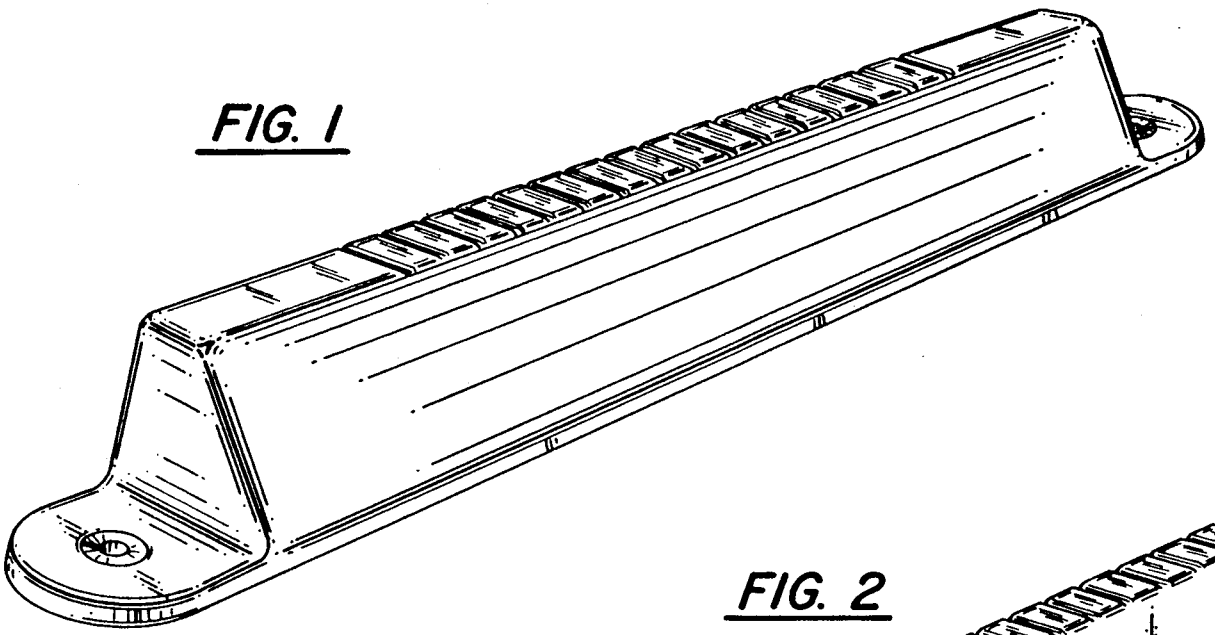
FIG. 1 is a front perspective view showing one side of a putting aid provided in accordance with the present invention.
Figure 2:
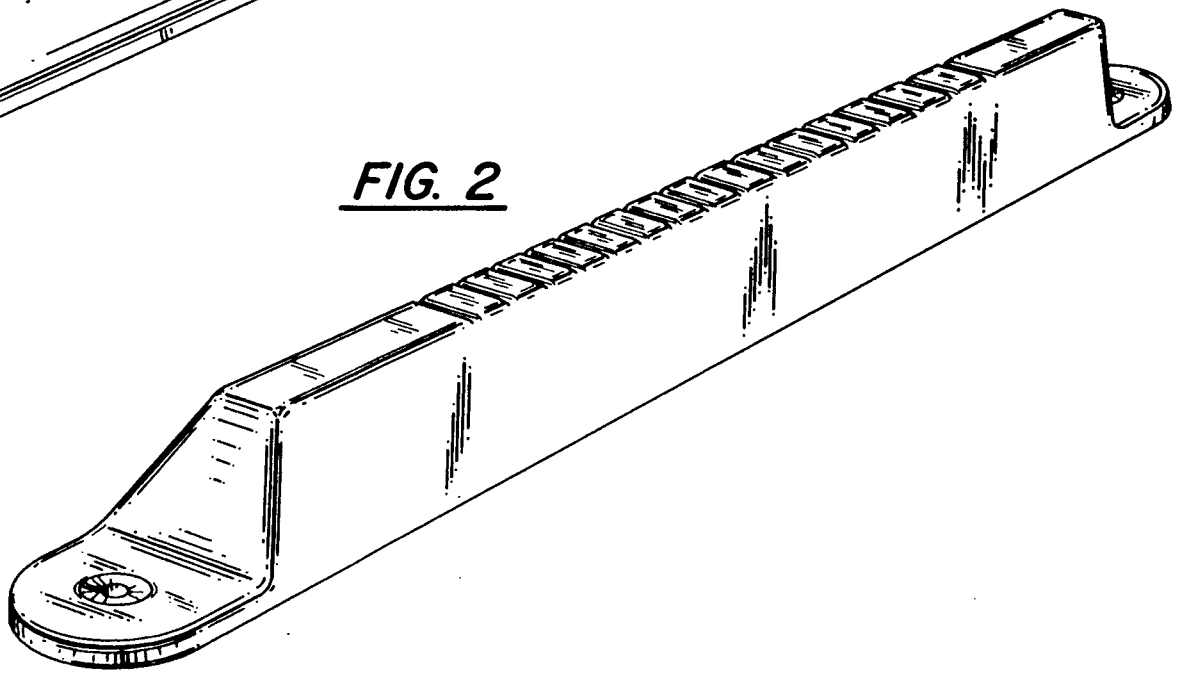
FIG. 2 is a rear perspective view showing the opposite side of the putting aid in accordance with the present invention.

As can be seen in particular in FIGS. 1 and 2, the putting aid 10 of the present invention is an elongate element which has first and second longitudinal side faces. The first longitudinal side face 12, as shown in particular in FIG. 1, is inclined at an angle of less than 90° relative to the plane of the base or bottom face 26 of the putting aid 10. As described more fully below, the inclined surface is used for practicing the in to in putting method wherein the putter is drawn in and up on the back swing and in and up on the follow through.

The other longitudinal side face 14 of the putting aid 10 of the invention, as shown in FIG. 2, is defined at an angle of about 90° relative to the plane of the base or bottom face 26 of the putting aid so as to be substantially vertical. As described more fully below, the vertical side face 14 is used for practicing straight putting wherein the putter follows a simple pendulum motion, drawn straight back with a straight follow through.

Figure 3:
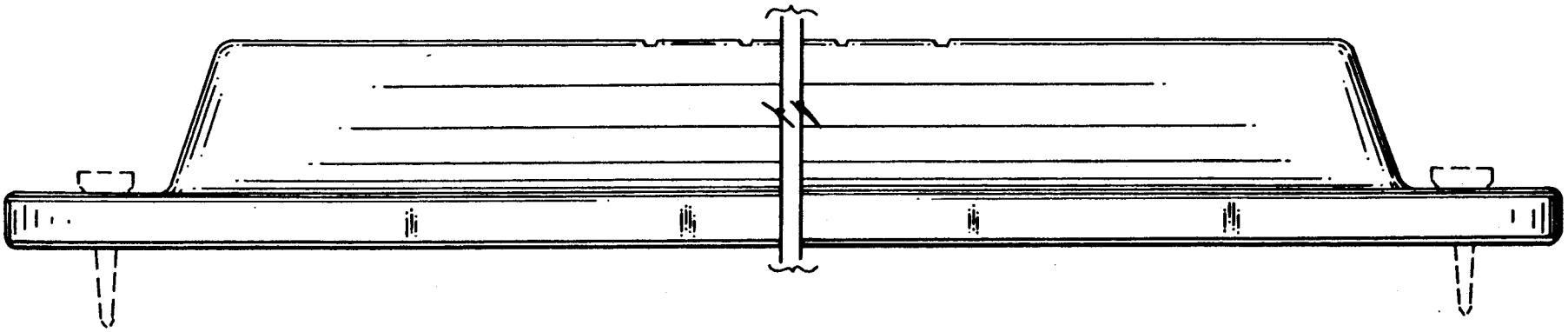
FIG. 3 is a front elevational view of the putting aid in accordance with the invention.
Figure 4:
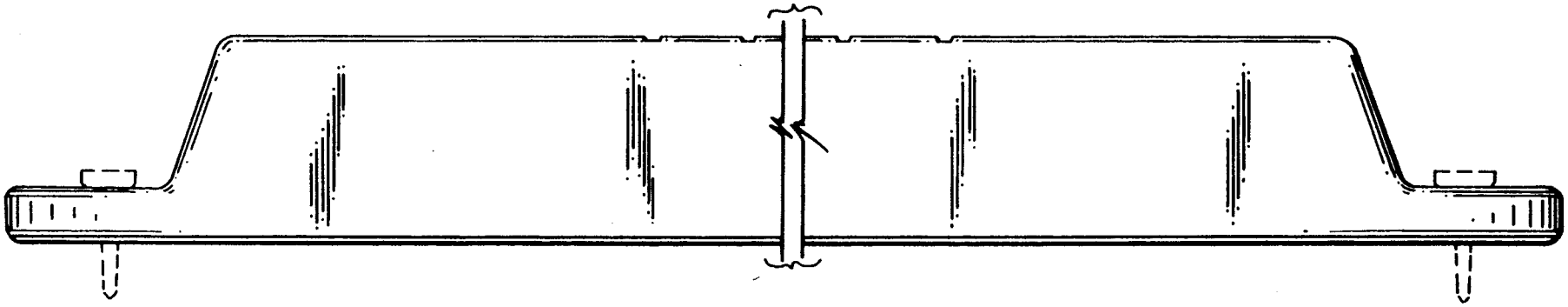
FIG. 4 is a rear elevational view of a putting aid in accordance with the invention.

An ear 16 is defined at each longitudinal end of the putting aid 10 with an aperture 18 for receiving a tee 20, as shown in phantom lines in FIGS. 3 and 4, when the aid 10 is used on the putting green. Thus if, for example, six foot putts are to be practiced by the golfer, one end of the putting aid 10 is secured to the green by inserting a tee 20 through the aperture 18 defined in the ear 16 at the forward end of the aid 10. The forward end of the aid 10 is determined by whether the vertical side face 14 or the inclined side face 12 is to be utilized and whether the golfer is right or left-handed. If the simple pendulum-type putting stroke is to be practiced, the putting aid 10 is oriented so that the vertical side face 14 faces the heel of the putter and the inclined side face 12 faces the golfer's feet. Once the forward end of the putting aid 10 has been secured to the green, the rearward end is moved so as to substantially align the putting path, which is in front of the putting aid 10, with the hole. One or more practice stroke(s) should be taken with the putting aid 10 before securing the rearward end so a to ensure that it is properly aligned with the hole. Once the aid 10 has been properly aligned with the hole, the rearward end is secured in position by inserting a tee 20 through the aperture 18 defined in the ear 16 at the rearward end.

Once the putting aid 10 has been properly aligned with the hole, the heel of the putter (not shown) is placed against the base of the aid approximately ⅓ of the way along the length of the putting aid from the forward end. The ball (not shown) is then set down in the sweet spot. A series of putts can then be practiced. Because the golfer can be certain that with the proper stroke the ball will consistently reach and enter the hole, he can place all of his concentration on the distance that the club should be drawn back with respect to the ball and whether the blade is being opened or closed during the stroke. Thus, all the golfer's concentration can be on the proper handling of the club head during the stroke and the stroke length rather than whether the entire golf club is being stroked along a line which intersects the target hole. Accordingly, the muscles will be trained to accomplish the putt while the putters concentration is on maintaining a square blade.

If the in to in putting stroke is to be practiced, the putting aid is simply turned around so that the inclined side face 12 faces the putter and the vertical side face 14 faces the user's feet. The golfer can then place the ball in the sweet spot, draw the club in and up on the back swing following the incline of the inclined side face 12 of the aid, swing the club down into contact with the ball, and glide the club in and up on the follow through. Again, repeated strokes following the inclined side face 12 of the putting aid will train the muscles of the user to repeat that stroke in the absence of the putting aid and will allow the golfer to concentrate upon maintaining the blade square to the ball and to the training aid to thereby consistently and accurately putt with the in to in method.

Figure 5:
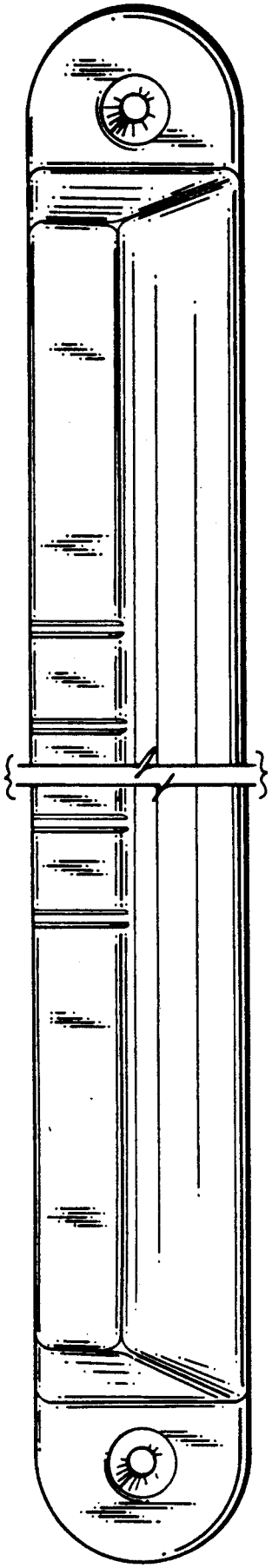
FIG. 5 is a top plan view of a putting aid in accordance with the present invention.

Indicia 22, as shown in particular in FIG. 5, are provided on the top or upper face 28 of the putting aid so that the user can determine a desired stroke length as well as maintain the blade square to the putting aid by aligning the front face of the putter head with the lines of indicia.

Figure 6:
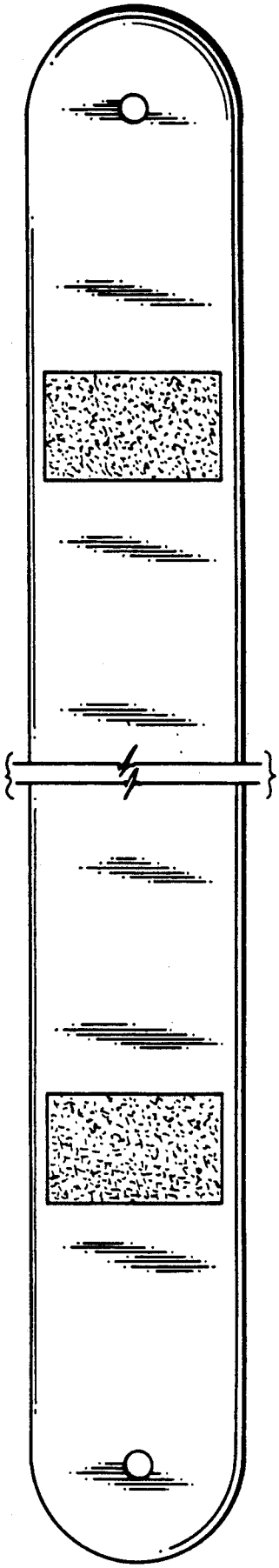
FIG. 6 is a bottom plan view of the putting aid in accordance with the present invention.
Figure 1:
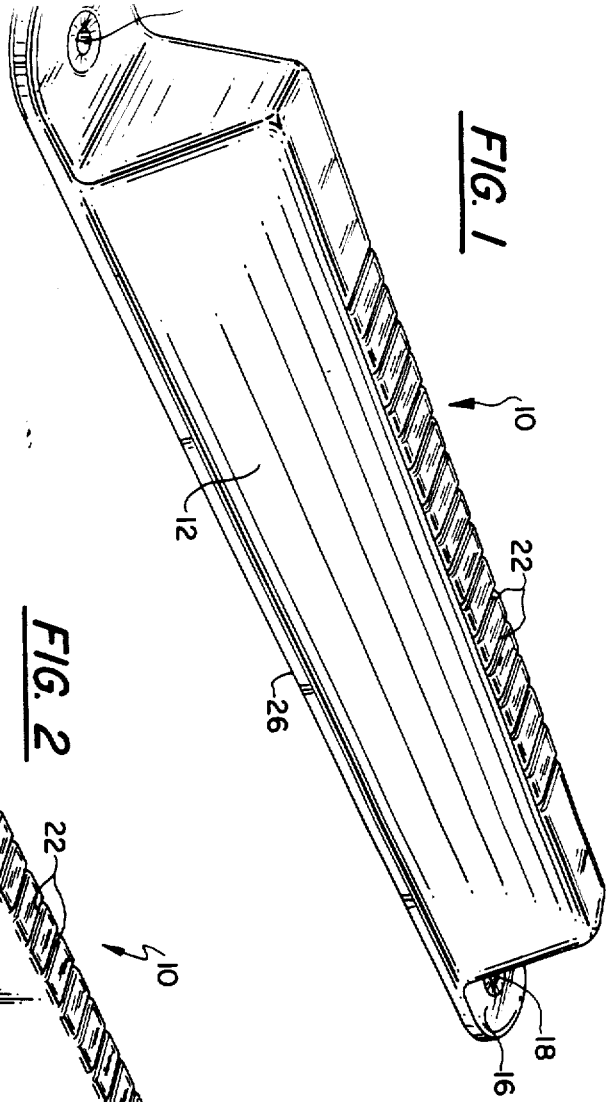
Figure 2:
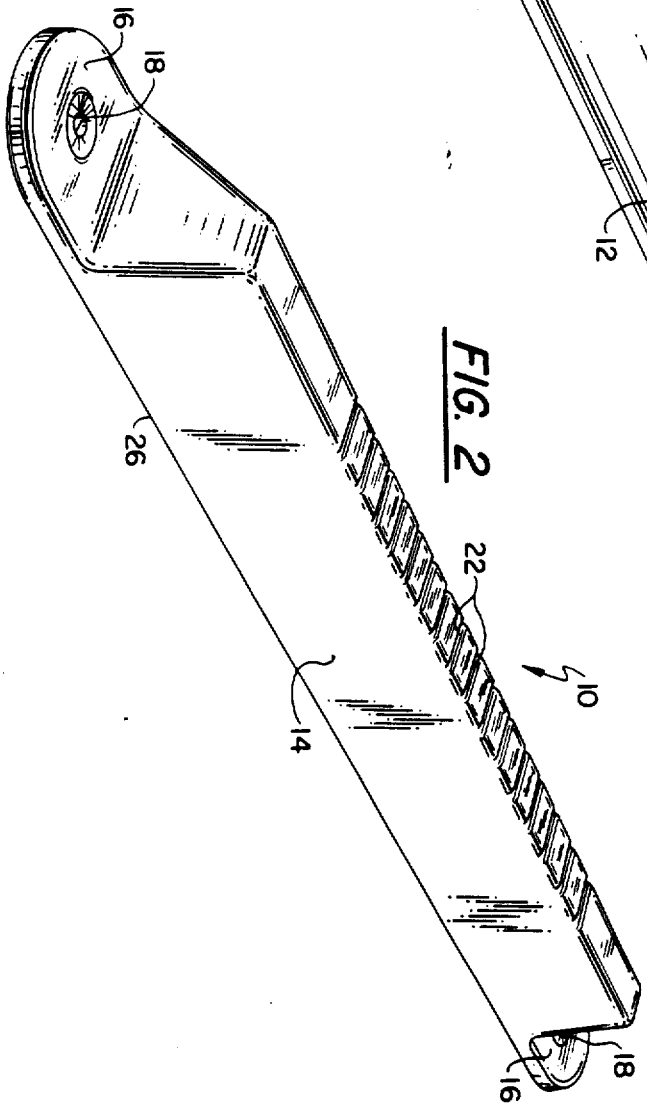
Figure 4:
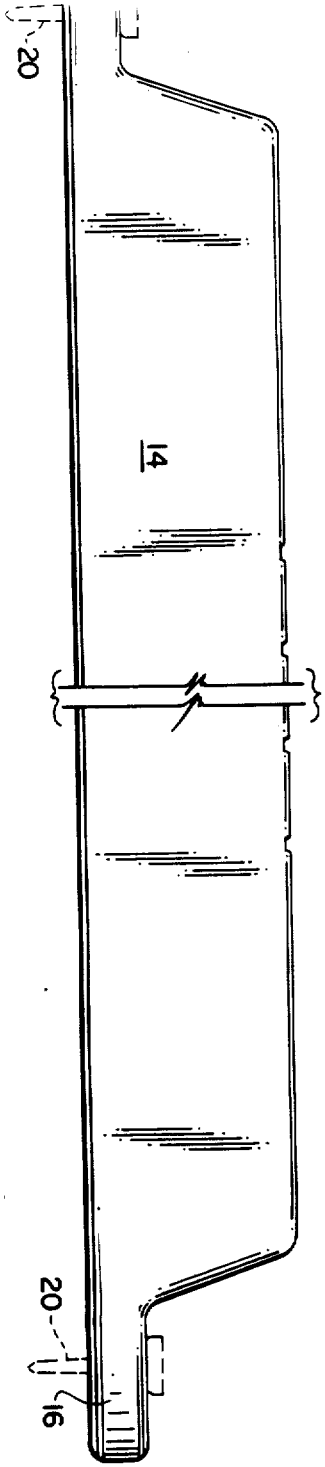
Figure 3:
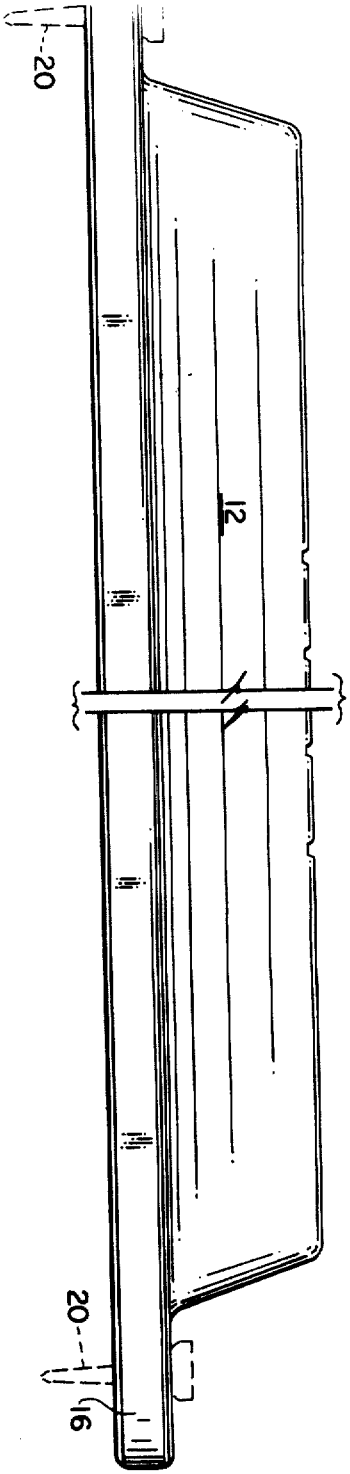
Figure 6:
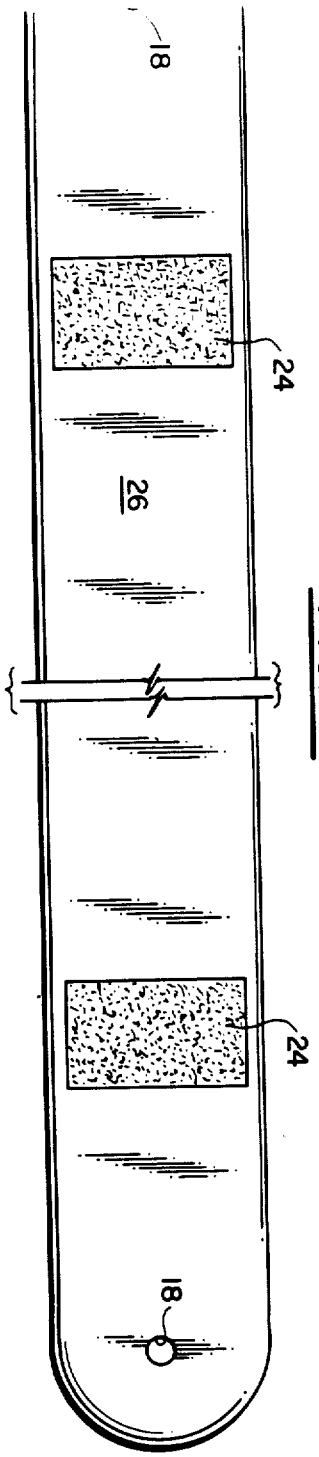
Figure 5:
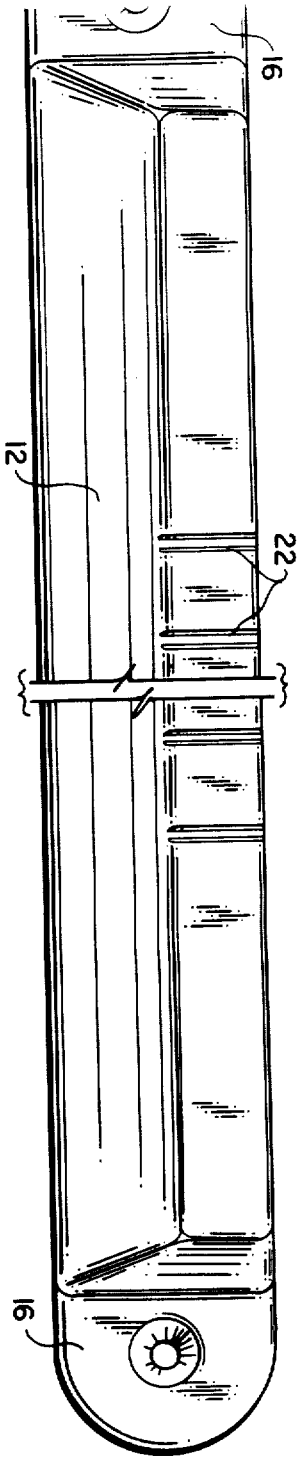

While the putting aid 10 has been described above in connection with use on a putting green with tees securing the longitudinal ends of the putting aid to the green, the putting aid provided in accordance with the present invention can be used for practicing putting indoors. More particularly, Velcro-type hook material 24 is preferably provided at spaced locations on the bottom face 26 of the aid, as shown for example in FIG. 6, which will secure the aid in place to household or business carpeting. While two strips of Velcro-type hook material have 24 been shown, it is to be understood that the entire undersurface of the putting aid 10 could be provided with Velcro-type hook material or a plurality of spaced pieces of Velcro-type hook material could be provided.

When the putting aid is used in the home or office to practice putting, a cup of paper or plastic material (not shown) can be provided to receive the golf ball in lieu of a hole. Any conventional cup can be provided for this purpose.

The putting aid itself is preferably molded from a plastic material but, of course, could be made from any suitable material(s) including metal and wood. Similarly, the surface of the device can be finished in any aesthetically pleasing manner and, if desired, customized to include the manufacturer or owner's name.

The trainer of the invention can be used to practice both the straight back and straight through and in to in putting strokes. The use of the training aid of the invention develops the proper muscle memory needed and the confidence which in the opinion of golf experts is necessary to achieve putting excellence in golfer's at all levels.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. An apparatus for practicing golf strokes comprising:

an elongated element having a bottom face, a longitudinal axis and first and second longitudinal ends;

means defining a substantially vertical longitudinal side face extending along at least a substantial portion of the length of said element, said vertical side face being defined in a plane disposed at an angle of substantially 90° with respect to a plane of said bottom face;

means defining an inclined longitudinal side face extending along at least a substantial portion of the length of said element, said inclined side face having a length substantially co-extensive with said vertical side face and being defined in a plane disposed at an angle of less than 90° with respect to the plane of said bottom face, a longitudinal top edge of said inclined side face being closely adjacent to a longitudinal top edge of said vertical side face;

whereby, when said vertical side face is aligned with a target, the heel of a putter can be placed against and guided along said vertical side face so as to practice a straight method stroke and, when said inclined longitudinal side face is aligned with the target, the heel of a putter can be guided rearwardly, inwardly and upwardly along the inclined side face and forwardly, inwardly and upwardly along the inclined side face so as to practice an in to in method stroke.

2. An apparatus as in claim 1, wherein said elongated element has a top face and further comprising indicia for indicating stroke length defined along said top face.

3. An apparatus as in claim 2, wherein the indicia comprise a plurality of lines, each disposed at an angle of about 90° relative to the longitudinal axis of the elongated element.

4. An apparatus as in claim 1, further comprising means for securing the elongated element to a playing surface.

5. An apparatus as in claim 4, wherein said means for securing comprises material disposed on said bottom face for removably securing the element to carpeting.

6. An apparatus as in claim 4, wherein said means for securing comprises an aperture defined at each longitudinal end of the elongated element for receiving a tee for securing the elongated element to the ground.

7. An apparatus as in claim 1, wherein the cross-sectional shape of said elongated element is a substantially right triangle with a truncated apex, said truncated apex defining a top face of said elongated element.

8. An apparatus as in claim 1, wherein said elongated element is formed from a plastic material.

9. An apparatus for practicing golf strokes comprising:

an elongated element having a longitudinal axis and first and second longitudinal ends, the elongated element including a base portion having a bottom face and a club head guide portion and means for securing said base portion to a putting surface, said guide portion having a length less than the length of said base portion;

means defining a substantially vertical longitudinal side face on said guide portion extending along at least substantial portion of the length of said guide portion, said vertical side face being defined in a plane disposed at an angle of substantially 90° with respect to a plane of said bottom face of said base portion;

means defining an inclined longitudinal side face extending along at least a substantial portion of the length of said guide portion, said inclined side face having a length substantially co-extensive with said vertical side face and being defined in a plane disposed at an angle of less than 90° with respect to the plane of said bottom face of said base portion;

whereby, when said vertical side face is aligned with a target, the heel of a putter can be placed against and guided along said vertical side face so as to practice a straight method stroke and, when said inclined longitudinal side face is aligned with the target, the heel of a putter can be guided rearwardly, inwardly and upwardly along the inclined side face and forwardly, inwardly and upwardly along the inclined side face so as to practice an in to in method stroke.

10. An apparatus as in claim 9, wherein said guide portion has a top face and further comprising indicia for indicating stroke length defined along said top face.

11. An apparatus as in claim 10, wherein the indicia comprise a plurality of lines, each disposed at an angle of about 90° relative to the longitudinal axis of the elongated element.

12. An apparatus as in claim 9, wherein said means for securing said base portion to a putting surface comprises material disposed on said bottom face of said base portion for removably securing said base portion to carpeting.

13. An apparatus as in claim 9, wherein said means for securing said base portion to a putting surface comprises an aperture defined through said base portion at each longitudinal end of the elongated element for receiving a tee for securing the base portion to the ground.

14. An apparatus as in claim 9, wherein said elongated element is formed from a plastic material.

15. An apparatus for practicing golf strokes comprising:

an elongated element having a top wall, a longitudinal axis and first and second longitudinal ends;

means defining a substantially vertical longitudinal side face extending along at least a substantial portion of the length of said element, said vertical side face being defined in a plane disposed at an angle of substantially 90° with respect to a horizontal plane;

means defining an inclined longitudinal side face extending along at least a substantial portion of the length of said element, said inclined side face having a length substantially co-extensive with said vertical side face and being defined in a plane disposed at an angle of less than 90° with respect to said horizontal plane;

said top wall extending between and interconnecting longitudinal top edges of said vertical side face and said inclined side face;

whereby, when said vertical side face is aligned with a target, the heel of a putter can be placed against and guided along said vertical side face so as to practice a straight method stroke and, when said inclined longitudinal side face is aligned with the target, the heel of a putter can be guided rearwardly, inwardly and upwardly along the inclined side face and forwardly, inwardly and upwardly along the inclined side face so as to practice an in to in method stroke.

16. An apparatus as in claim 15, further comprising indicia for indicating stroke length defined along a top face of said top wall.

17. An apparatus as in claim 15, further comprising means for securing the elongated element to a playing surface.

18. An apparatus for practicing golf strokes comprising:

an elongated element having a longitudinal axis and first and second longitudinal ends;

means defining a substantially vertical longitudinal side face extending along at least a substantial portion of the length of said element, said vertical side face being defined in a plane disposed at an angle of substantially 90° with respect to a horizontal plane;

means defining an inclined longitudinal side face extending along at least a substantial portion of the length of said element, said inclined side face having a length substantially co-extensive with said vertical side face and being defined in a plane disposed at an angle of less than 90° with respect to said horizontal plane;

said elongated element, said means defining a vertical longitudinal side face, and said means defining an inclined longitudinal side face being interconnected so that said vertical side face and said inclined side face are disposed in predetermined, fixed, spaced relation and predetermined, fixed, angular orientation with respect to one another;

whereby, when said vertical side face is aligned with a target, the heel of a putter can be placed against and guided along said vertical side face so as to practice a straight method stroke and, when said inclined longitudinal side face is aligned with the target, the heel of a putter can be guided rearwardly, inwardly and upwardly along the inclined side face and forwardly, inwardly and upwardly along the inclined side face so as to practice an in to in method stroke.

19. An apparatus as in claim 18, further comprising means for securing said elongated element with respect to a playing surface.

20. An apparatus for practicing golf strokes comprising:

an elongated element having a longitudinal axis and first and second longitudinal ends;

means defining a substantially vertical longitudinal side face extending along at least a substantial portion of the length of said element, said vertical side face being defined in a plane disposed at an angle of substantially 90° with respect to a horizontal plane;

means defining an inclined longitudinal side face extending along at least a substantial portion of the length of said element, said inclined side face having a length substantially co-extensive with said vertical side face and being defined in a plane disposed at an angle of less than 90° with respect to said horizontal plane;

said elongated element, said means defining a substantially vertical longitudinal side face, and said means defining an inclined longitudinal face being formed as one piece integral structure;

whereby, when said vertical side face is aligned with a target, the heel of a putter can be placed against and guided along said vertical side face so as to practice a straight method stroke and, when said inclined longitudinal side face is aligned with the target, the heel of a putter can be guided rearwardly, inwardly and upwardly along the inclined side face and forwardly, inwardly and upwardly along the inclined side face so as to practice an in to in method stroke.

21. An apparatus as in claim 20, wherein said elongated element, said means defining a substantially vertical longitudinal side face and said means defining an inclined longitudinal side face are formed from plastic.

* * * * *

UNITED STATES PATENT AND TRADEMARK OFFICE

CERTIFICATE OF CORRECTION

PATENT NO. : 5,024,442

DATED : June 18, 1991

INVENTOR(S) : SINDELAR

It is certified that error appears in the above-identified patent and that said Letters Patent is hereby corrected as shown below:

The title page should be deleted to appear as per attached sheet.

The sheets of Drawings consisting of figures 1-6 should be deleted to appear as per attached sheets.

Signed and Sealed this

Second Day of March, 1993

*Attest:*

STEPHEN G. KUNIN

*Attesting Officer*

*Acting Commissioner of Patents and Trademarks*

United States Patent [19]

Sindelar, Sr.

[11] Patent Number: 5,024,442

[45] Date of Patent: Jun. 18, 1991

[54] PUTTING PRACTICE DEVICE

[76] Inventor: Joseph L. Sindelar, Sr., 2121 Hancock Dr., Horseheads, N.Y.

[21] Appl. No.: 540,350

[22] Filed: Jun. 19, 1990

[51] Int. Cl.[5] ..... A63B 69/36

[52] U.S. Cl. ..... 273/186 C; 273/192

[58] Field of Search ..... 273/191 R, 191 A, 191 B, 273/192, 186 R, 186 B, 186 C, 183 E

[56] References Cited

U.S. PATENT DOCUMENTS

| | | | |
|---|---|---|---|
| 1,545,648 | 7/1925 | Fletcher | 273/192 |
| 2,750,195 | 6/1956 | Ching | 273/183 A |
| 2,754,125 | 7/1953 | Engler | 273/192 |
| 2,776,836 | 1/1957 | Zadina | 273/192 |
| 3,125,343 | 3/1964 | Price | 273/186 R |
| 3,332,688 | 7/1967 | Gevertz | 273/192 |
| 3,656,752 | 4/1972 | Moriarty | 273/192 |
| 3,697,080 | 10/1972 | Liotta | 273/186 R |
| 3,753,563 | 8/1973 | Previte | 273/186 C |
| 3,806,133 | 4/1974 | Cork | 273/192 |
| 4,101,130 | 7/1978 | Richards | 2273/187 A |
| 4,398,715 | 8/1983 | Hall | 273/030 |
| 4,453,717 | 6/1984 | Solheim | 273/192 |
| 4,765,624 | 8/1988 | Sprague | 273/192 |
| 4,805,912 | 2/1989 | Hickman | 273/192 |
| 4,927,153 | 5/1990 | Schaeffer | 273/187 R |

*Primary Examiner*—George J. Marlo

*Attorney, Agent, or Firm*—Cushman, Darby & Cushman

[57] ABSTRACT

An elongated putting training aid including lengthwise adjacent and coextensive guide surfaces on its opposite sides defining, respectively, a vertical putter guide surface and an inclined putter guide surface. The vertical putter guide surface enables the golfer to practice straight putting by aligning the vertical surface with a target hole or cup. The inclined surface is utilized for practicing in to in putting wherein the club is drawn in and up on the back swing and in and up on the follow through. The putting aid can be secured to the putting green by inserting tees through suitably disposed apertures in each longitudinal end thereof. In the alternative, the putting aid can be secured to carpeting with a hook-type material provided on the bottom surface thereof.

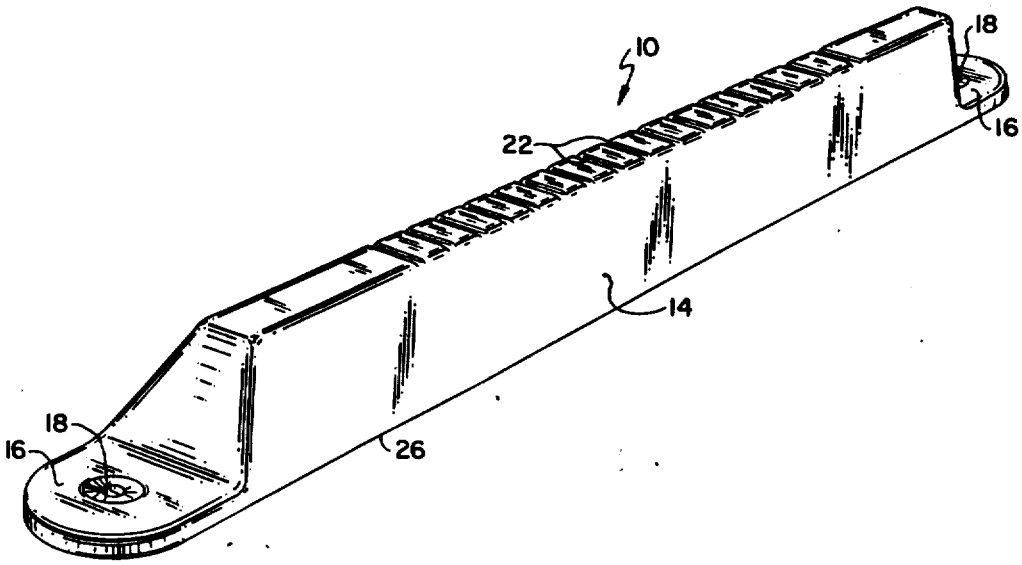

21 Claims, 3 Drawing Sheets